US005704805A

United States Patent [19]

Douty et al.

[11] Patent Number: 5,704,805

[45] Date of Patent: Jan. 6, 1998

[54] CONNECTOR FOR CONNECTION TO A RAIL

[75] Inventors: George Harold Douty, Mifflintown; John Michael Landis, Camp Hill; Charles Harry Weidler, Lancaster, all of Pa.

[73] Assignee: The Whitaker Corporation, Wilmington, Del.

[21] Appl. No.: 620,962

[22] Filed: Mar. 22, 1996

Related U.S. Application Data

[63] Continuation-in-part of Ser. No. 414,883, Mar. 31, 1995, abandoned.

[51] Int. Cl.[6] ..... H01R 9/26

[52] U.S. Cl. ..... 439/532; 439/716; 439/717

[58] Field of Search ..... 439/94, 532, 716, 439/717

[56] References Cited

U.S. PATENT DOCUMENTS

| | | | |
|---|---|---|---|
| 2,983,897 | 5/1961 | Blanchet | 339/198 |
| 3,018,464 | 1/1962 | Mrenna et al. | 339/198 |
| 3,260,986 | 7/1966 | Staffel | 339/198 |
| 3,293,593 | 12/1966 | Nielsen et al. | 339/198 |
| 4,220,392 | 9/1980 | Debaigt | 339/198 N |
| 4,234,239 | 11/1980 | Wilmes et al. | 339/198 GA |
| 4,269,471 | 5/1981 | Woertz | 339/198 GA |
| 4,454,382 | 6/1984 | Borne et al. | 174/158 R |
| 4,698,726 | 10/1987 | Ootsuka et al. | 361/335 |
| 4,776,815 | 10/1988 | Baillet et al. | 439/724 |
| 4,846,722 | 7/1989 | Heng et al. | 439/439 |
| 4,878,859 | 11/1989 | Haller et al. | 439/716 |
| 4,900,275 | 2/1990 | Fasano | 439/716 |
| 4,940,431 | 7/1990 | Hennemann | 439/716 |
| 4,968,272 | 11/1990 | Hanning et al. | 439/716 |
| 5,049,094 | 9/1991 | Heng et al. | 439/716 |
| 5,071,356 | 12/1991 | Strate et al. | 439/716 |
| 5,090,922 | 2/1992 | Rymer et al. | 439/716 |
| 5,114,367 | 5/1992 | Bolliger | 439/716 |
| 5,135,415 | 8/1992 | Huber | 439/716 |
| 5,145,418 | 9/1992 | Moranski et al. | 439/716 |
| 5,174,767 | 12/1992 | Diekmann et al. | 439/94 |
| 5,192,227 | 3/1993 | Bales | 439/532 |
| 5,249,979 | 10/1993 | Deinhardt et al. | 439/341 |
| 5,299,957 | 4/1994 | Schaeffer | 439/712 |
| 5,362,259 | 11/1994 | Bolliger | 439/716 |
| 5,508,886 | 4/1996 | Bernecker et al. | 361/733 |
| 5,602,363 | 2/1997 | Von Arx | 174/52.1 |

FOREIGN PATENT DOCUMENTS

| | | | |
|---|---|---|---|
| 0 364 745 | 4/1990 | European Pat. Off. | H01R 9/26 |
| 2 410 160 | 6/1979 | France | H01R 9/22 |
| 2432258 | 3/1980 | France . | |
| 628 467 | 2/1982 | Switzerland | F01R 9/26 |
| 629 038 | 3/1982 | Switzerland | H01R 9/26 |

OTHER PUBLICATIONS

Phoenix Contact Data Sheet, "Interbus–S IBS ST 24 BK–T Bus Terminal", Aug. 1994; five pages; Phoenix Contact Inc., Harrisburg, PA.

International Search Report dated Aug. 23, 1996; Corresponding application PCT/US96/04259.

*Primary Examiner*—Gary E. Elkins

*Attorney, Agent, or Firm*—Anton P. Ness

[57] ABSTRACT

An electrical connector (1,100) for a DIN rail (2) with rail flanges (6), including a body (3,102), a carrier (16,104) vertically movable with respect to the body (3,102), an actuator (14,110) and a pair of clamp members (5,106,108) having rail-engageable hook portions (26,148). At least one of the clamp members (5,106,108) is movable toward the other by the carrier (16,104) upon actuation for mechanically and electrically clamping onto a respective rail flange (6). A pair of such clamp members (5) may be cammed inwardly and upwardly along slots (30) in side walls (9) of body (3) upon actuation, or the clamp members (106,108) may include flanges (158) pivotably held in body side wall holes (162) for rotating the hook portions (148) inwardly and upwardly against the rail flanges (6). Such connector (1,100) is adapted to be mounted beneath a circuit board (10) prior to being clamped onto the DIN rail (2).

23 Claims, 7 Drawing Sheets

CONNECTOR FOR CONNECTION TO A RAIL

RELATED APPLICATION INFORMATION

This is a Continuation-in-Part of U.S. patent application Ser. No. 08/414,883 filed Mar. 31, 1995, ABN.

FIELD OF THE INVENTION

The invention relates generally to electrical connectors and more particularly to connectors for connection to a rail.

BACKGROUND OF THE INVENTION

Various types of connectors have been devised for being secured to a DIN or top hat rail, that is an elongated conductive channel shaped member having side edge flange portions therealong to which connector engagement is made. In U.S. Pat. No. 5,174,767 is disclosed an assembly for connecting a ground conductor to a DIN (or top hat) rail. The assembly includes a first sheet metal member arranged for seated engagement transversely atop the rail flanges, a second sheet metal member including at each end a hook portion to extend beneath the rail flanges, and a screw through aligned apertures of both members for moving the second member upwardly relative to the first member upon screw rotation, thereby clamping the hook portions against the bottom surfaces of the rail flanges. The assembly also includes a guide arrangement for guiding the relative movement of the two members in a vertical direction. The pair of hook portions are fixed in their relative positions by being integral with the second member, and the connector is easily assembled to the DIN rail by being manipulated while being directly observed by the service personnel performing the assembly, to bring one hook member beneath an associated rail flange and then the other hook member beneath the other rail flange, followed by being tightened against the respective rail flanges upon rotation of the screw.

It is desired to provide a connector that is securable to a DIN rail while being affixed beneath a large module that prevents manipulation of the connector during rail securement and also visual observation of the securing procedure, all in a manner to result in assuredly clamping the connector to the DIN rail while permitting intentional connector removal from the DIN rail and yet preventing inadvertent disengagement therefrom.

SUMMARY OF THE INVENTION

The present invention provides assured clamping and electrical connection utilizing a connector assembly having clamps that are movable with respect to each other to hook onto and be released from the DIN rail flanges by actuation and deactuation of an actuation mechanism.

The present invention is a connector for establishing a mechanical and electrical connection to flanges of an elongated DIN rail by clamps of the connector that are relatively movable toward and away from each other to establish or release a clamping and grounding connection. At least one and preferably both of the clamps of the connector are incrementally movable with respect to the connector and provide respective hooks whose positions are movable from outward positions permitting being placed to both sides of the DIN rail flanges, relatively toward each other to become engageable with and under respective rail side edges upon actuation of an actuator, such as a screw.

In a further aspect, the present connector is adapted to be mounted beneath another article such as a module or a circuit board at the time it is to be clamped onto the DIN rail, with the actuator being actuatable along a rail-remote surface of the connector. In a first embodiment, upon actuation both clamps are urged inwardly and upwardly along camming slots of a body member, with the rail engaging hooks correspondingly moving inwardly and upwardly into clamping engagement with the rail side edges. In a second embodiment, the clamps are pivoted upon actuation to rotate the hooks into rail engagement.

Preferably the connector includes a carrier member movable with respect to the body and at least one of the clamp members upon actuation. Further, it is preferred that the clamp members be rigid and nondeflectable.

Embodiments of the present invention will now be described by way of example with reference to the accompanying drawings.

DETAILED DESCRIPTION

In FIGS. 1 to 12 is illustrated a first embodiment of the DIN rail connector of the present invention, with a second embodiment shown in FIGS. 13 to 16.

Figure 1:
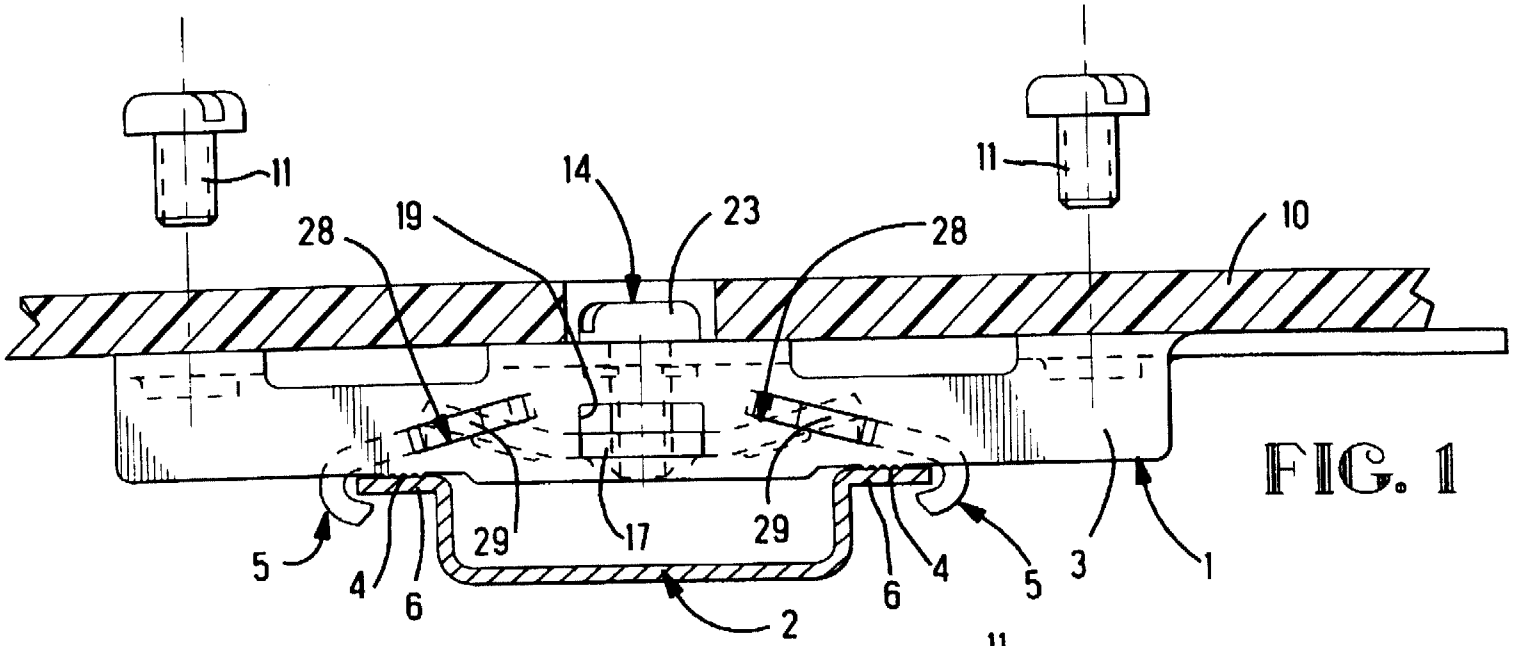
FIGS. 1 and 2 are section views of a first embodiment of the connector of the present invention being secured beneath a circuit board and to a DIN rail.
Figure 2:
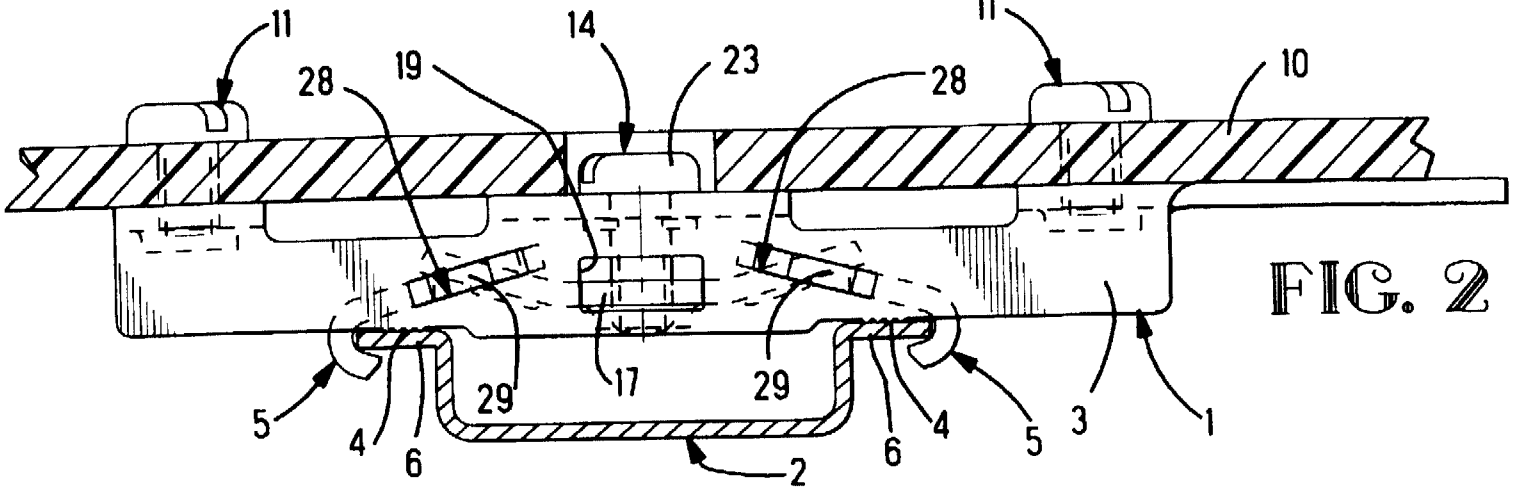
Figure 3:
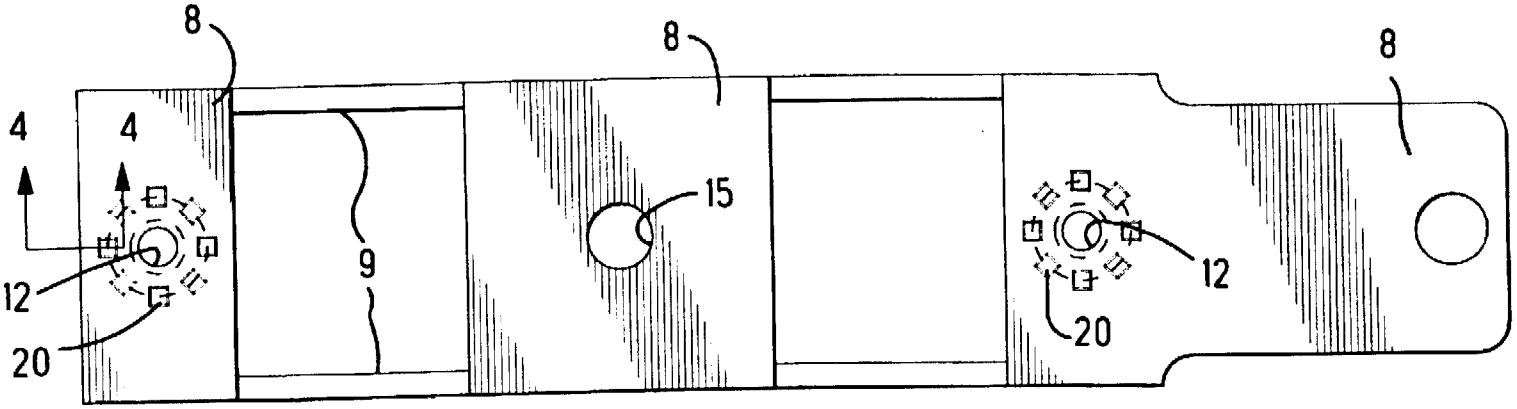
FIGS. 3 to 6 are top, section side and end views of a bracket of the connector of FIGS. 1 and 2, with FIG. 4 taken along lines 4—4 of FIG. 3.
Figure 4:
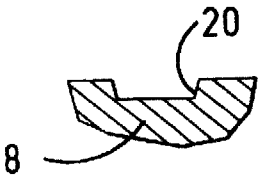
Figure 5:
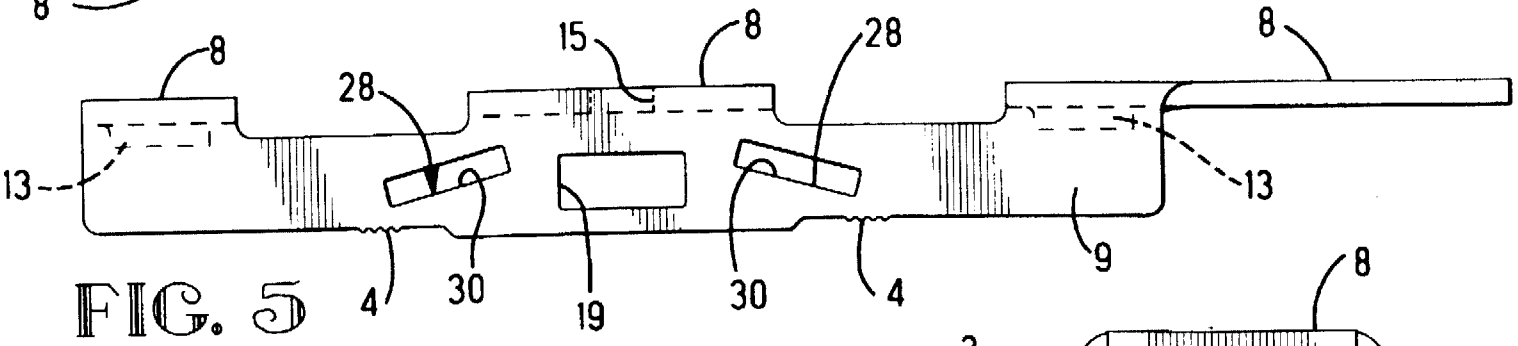
Figure 6:
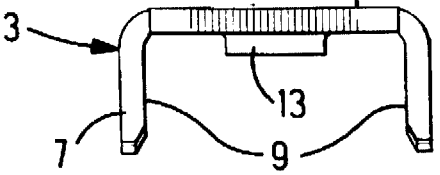

With reference to FIGS. 1 and 2, an electrical connector 1 for a DIN rail 2 comprises a body or bracket 3, at least one rail engaging portion 4 on bracket 3 facing downwardly toward DIN rail 2, and at least one movable clamp or jaw 5 to clamp the DIN rail against the rail engaging portion 4. In the drawings, two jaws 5 are shown. The connector 1 is for the purpose of connection electrically to the elongated, metal DIN rail 2 of known construction. For example, the DIN rail 2 is channel shaped, and exterior straight flanges or sides 6 are provided on edges along DIN rail 2.

With reference to FIGS. 3 to 6, bracket 3 is of unitary construction, stamped and formed from a metal plate having a thickness. The bracket 3 has an inverted channel 7 with a discontinuous bottom 8 on channel 7, and with opposite sides 9 on channel 7 being side walls that extend from bottom 8. Bottom 8 provides an exterior upwardly facing rail-remote mounting surface on connector 1. The connector is especially useful to be mounted and connected electrically to another device, for example, a substrate such as a circuit board 10 (FIGS. 1 and 2) by a pair of mounting screws 11.

Screws 11 are threadedly attached in internally threaded openings 12 through bottom 8 on channel 7. Indented embossments 20 encircle each opening 12, and each of the threaded openings extends through a corresponding collar 13 projecting out of the thickness of the bottom. Each collar 13 is created by drawing the collar outward from the thickness of the channel bottom. With screws 11 in engagement with ground circuits of the circuit board, a ground connection is defined with the connector.

Rail engaging portions 4 are on edges along the opposite sides 9 of channel 7, and are serrations to concentrate forces applied to the surface of the rail 2 to penetrate and break oxides on the surfaces of rail flanges 6 and establish excellent electrical grounding connection with DIN rail 2. Rail engaging portions 4 face downwardly to engage the opposite sides of the DIN rail.

Figure 10:
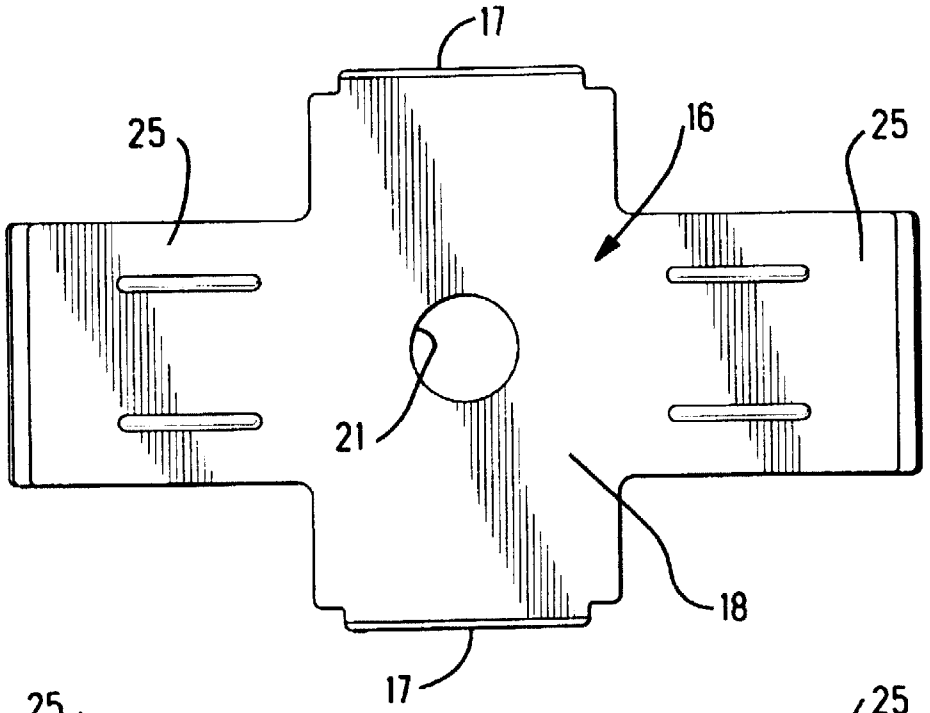
FIGS. 10 to 12 are top, side and end views of a lifting cam of the connector of FIGS. 1 and 2.
Figure 11:
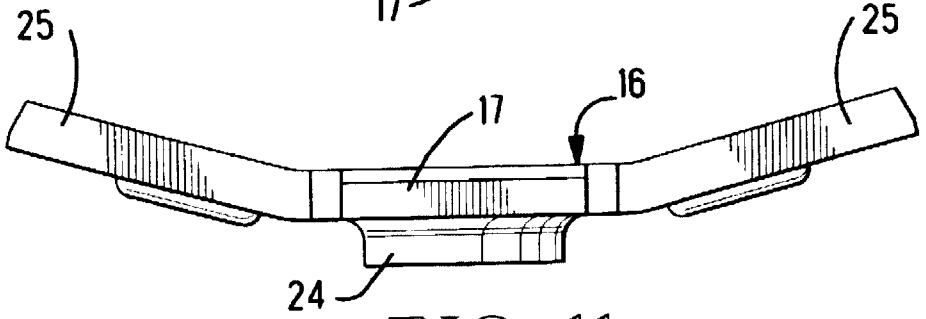
Figure 12:
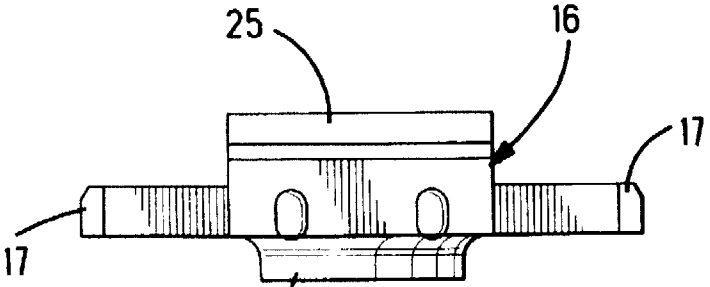

With reference again to FIGS. 1 and 2, an actuator such as threaded drive screw 14 extends rotatably through an opening 15 through the bracket 3, and preferably is threaded for clockwise rotation to attain clamping. Drive screw 14 is positioned between the respective rail engaging portions 4. With reference to FIGS. 10 to 12, a carrier or lifting cam 16 threadably receives drive screw 14 for relative rotation. Lifting cam 16 draws each jaw 5 toward the rail engaging portion 4 upon rotation of the drive screw. A second rail engaging portion 4 on bracket 3 faces toward the DIN rail, a second movable jaw 5 is movable toward the rail engaging portion to clamp the DIN rail against the second rail engaging portion 4, and the lifting cam 16 biases both jaws 5 for movement toward respective rail engaging portions 4 upon rotation of the drive screw 14.

The lifting cam is of unitary construction stamped and formed form a plate of metal having a thickness plane. A pair of tabs 17 project in the thickness plane of a central portion 18, and project in opposite directions from opposite extending edges of lifting cam 16. The tabs span the width of respective vertical windows or slots 19 through the opposite sides 9 of channel 7 and are captured in slots 19 for vertical movement when drive screw 14 is rotated; sides 9 prevent any rotation of lifting cam 16 during actuation and deactuation. A threaded opening 21 in central portion 18 of lifting cam 16 threadably receives the drive screw, and upon clockwise rotation of drive screw 14, lifting cam 16 is drawn inwardly along drive screw 14 toward the screw head 23. Drive screw 14 lifts lifting cam 16 further into the interior of channel 7. Threaded opening 21 extends through a corresponding collar 24 (FIG. 11) projecting out of the thickness of the lifting cam 16. Collar 24 is created by drawing the collar 24 outwardly from the thickness of the lifting cam. Upwardly projecting arms 25 extend diagonally from the central portion 18 of lifting cam 16 to engage respective jaws 5.

Figure 7:
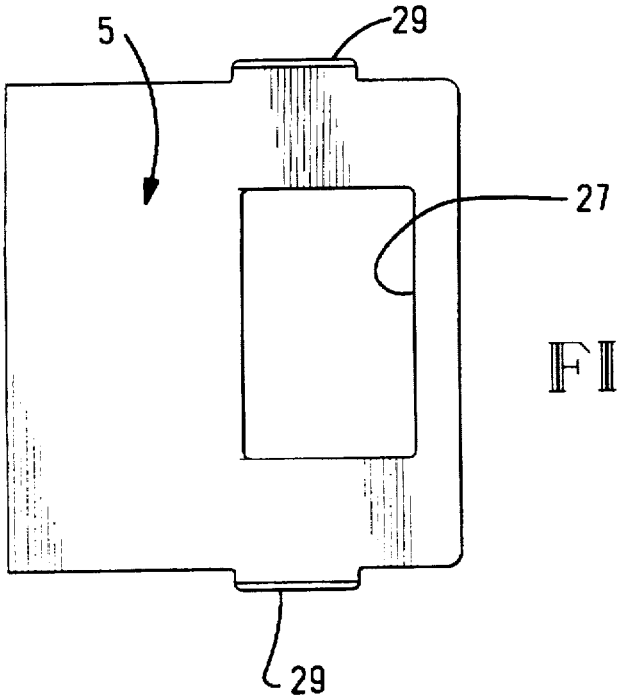
FIGS. 7 to 9 are top, section and side views of a jaw of the connector of FIGS. 1 and 2.
Figure 8:
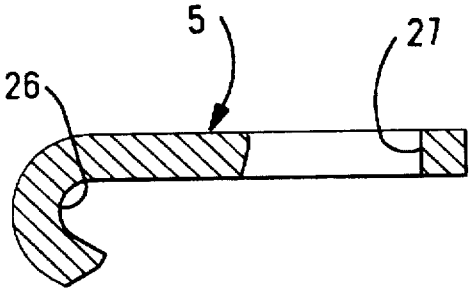
Figure 9:
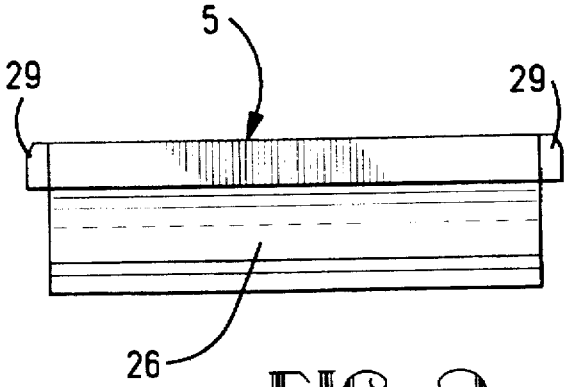

With reference to FIGS. 7 to 9, each jaw 5 is of unitary construction, stamped and formed from a metal plate having a thickness. Each jaw 5 is turned back on itself at one end to provide a hook 26 at the one end. The hook 26 extends downwardly and faces inwardly toward a corresponding side 6 of DIN rail 2 (FIGS. 1 and 2). The remainder of each jaw 5 is straight. A slot 27 is rectangular in shape, and extends through the remainder of jaw 5. Arms 25 of lifting cam 16 are received in respective slots 27 through jaws 5, whereby the lifting cam 16 engages respective jaws 5 and biases them for movement toward the rail engaging portions 4 along respective inclined tracks 28, (FIGS. 1 and 2), upon rotation of drive screw 14.

On each jaw 5, a pair of projecting tabs 29 project in the thickness plane of each remainder. The bracket 3 provides the inclined tracks 28 that extend along the bracket. Each track 28 is in the form of inclined camming slots 30 (FIG. 5) through opposite sides 9 of channel 7. Camming slots 30 on the same side 9 have identical vertical positions and have closed ends, and camming slots 30 through opposite sides 9 of channel 7 are aligned with each other. Each jaw is received in the interior of the channel 7, between opposite sides 9 of channel 7. Flanges or tabs 29 on each jaw are movable by being slidable in and along the respective inclined camming slots 30 through opposite sides 9 of channel 7. The tabs are not pivotable in the slots, and this keeps the jaws from closing toward each other through pivoting, while moving gradually toward each other through translation. Optionally, the slots 30 may be horizontal if the rail-engaging surfaces of the jaws were inclined, such that movement of each jaw toward the associated rail edge assures that the edge will eventually engage the inclined jaw surface for clamping.

Jaw 5 is movable in a resultant direction along respective inclined tracks 28 to clamp the DIN rail 2 against the rail engaging portions 4, and the resultant direction extends both laterally of each of the rail engaging portions 4 and toward each of the rail engaging portions 4.

An advantage of the invention is that downward projecting hooks 26 are drawn toward opposite sides 6 on the DIN rail, whereby connector 1 is adjustable for connection to different sizes, widths and thicknesses, of DIN rails 2. Another advantage resides in a lifting cam 16 driven by a drive screw 14 having right hand threads to draw downward projecting hooks 26 toward opposite sides 6 on the DIN rail, and the hooks are drawn toward rail engaging portions 4 on a bracket that project downwardly to engage and clamp on the opposite sides 6 of the DIN rail.

Referring now to FIGS. 13 to 16, connector 100 includes a body 102, a carrier 104, a pair of clamps 106,108 and an actuator 110. Body 102 includes a planar top or rail-remote surface 112 and side walls 114,116 with top surface 112 defined by a central top wall portion 118 and spaced-apart outer top wall portions 120,122. Central top wall portion 118 includes an actuator-receiving aperture 124 therethrough while outer top wall portions 120,122 include respective fastener-receiving apertures 126,128 therethrough, all similar to connector 1 of FIGS. 1 to 12.

Carrier 104 is positioned beneath central top wall portion 118 and includes a threaded actuator-receiving hole 130 aligned with actuator-receiving aperture 124. Carrier 104 is secured to body 102 by tabs 132 extending from side edges 134 held in windows 136 through side walls 114,116 located centrally therealong, with windows 136 being shaped and dimensioned to permit tabs 132 to be movable vertically therewithin such that carrier 104 is movable vertically with respect to body 102. Side walls 114,116 prevent any rotation of carrier 104 with respect to body 102 during actuation and deactuation.

Ends 138 of carrier 104 include respective pairs of upturned flanges 140 at the corners, with the flanges of each pair being spaced apart by slots 142. Upper ends 144 of flanges 140 of each pair define projections 146 extending toward each other to at least partially close slots 142. Each clamp member 106,108 includes a U-shaped DIN rail hook portion 148 extending from a planar body portion 150, with hook portion 148 preferably including one or more teeth 152 along free edge 154 such as at the ends thereof and optionally centrally therealong as well to establish an assured ground connection with the DIN rail upon actuation of the clamp assembly.

Planar body portion 150 includes a carrier-engageable portion or tongue 156 adapted to be inserted through a respective slot 142 of carrier 104 and sufficiently wide to be held beneath projections 146, while the height of the slot is enough to permit the tongue to move between a limited range of angular orientations beneath projections 146 between fully actuated and fully deactuated positions of said clamp members 106,108. A pair of flanges 158 extend from side edges 160 of planar body portion 150 adapted to be received into and trapped within corresponding circular holes 162 in side walls 114,116 of body 102, and are preferably dimensioned just small enough to be movable in holes 162 to permit rotation therewithin.

A clamp assembly 100 is defined when flanges 158 of clamps 106,108 are inserted into holes 162 in the body side walls 114,116 and tongues 156 are disposed in slots 142 of carrier 104 beneath projections 146 and tabs 132 are disposed in windows 136, all without the utilization of discrete fasteners and in a manner permitting certain limited movement of the carrier, clamps and body with respect to each other as will now be explained.

Figure 13:
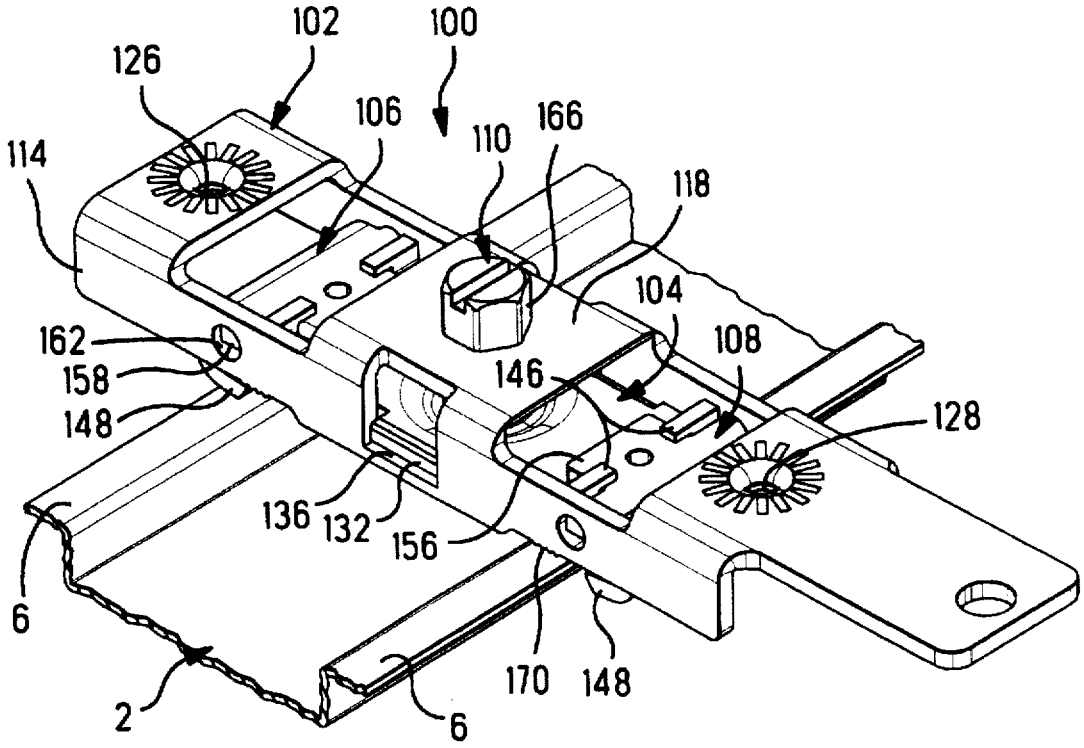
FIG. 13 is an isometric view of a second embodiment of the present invention poised above a DIN rail to be mounted thereto.
Figure 14:
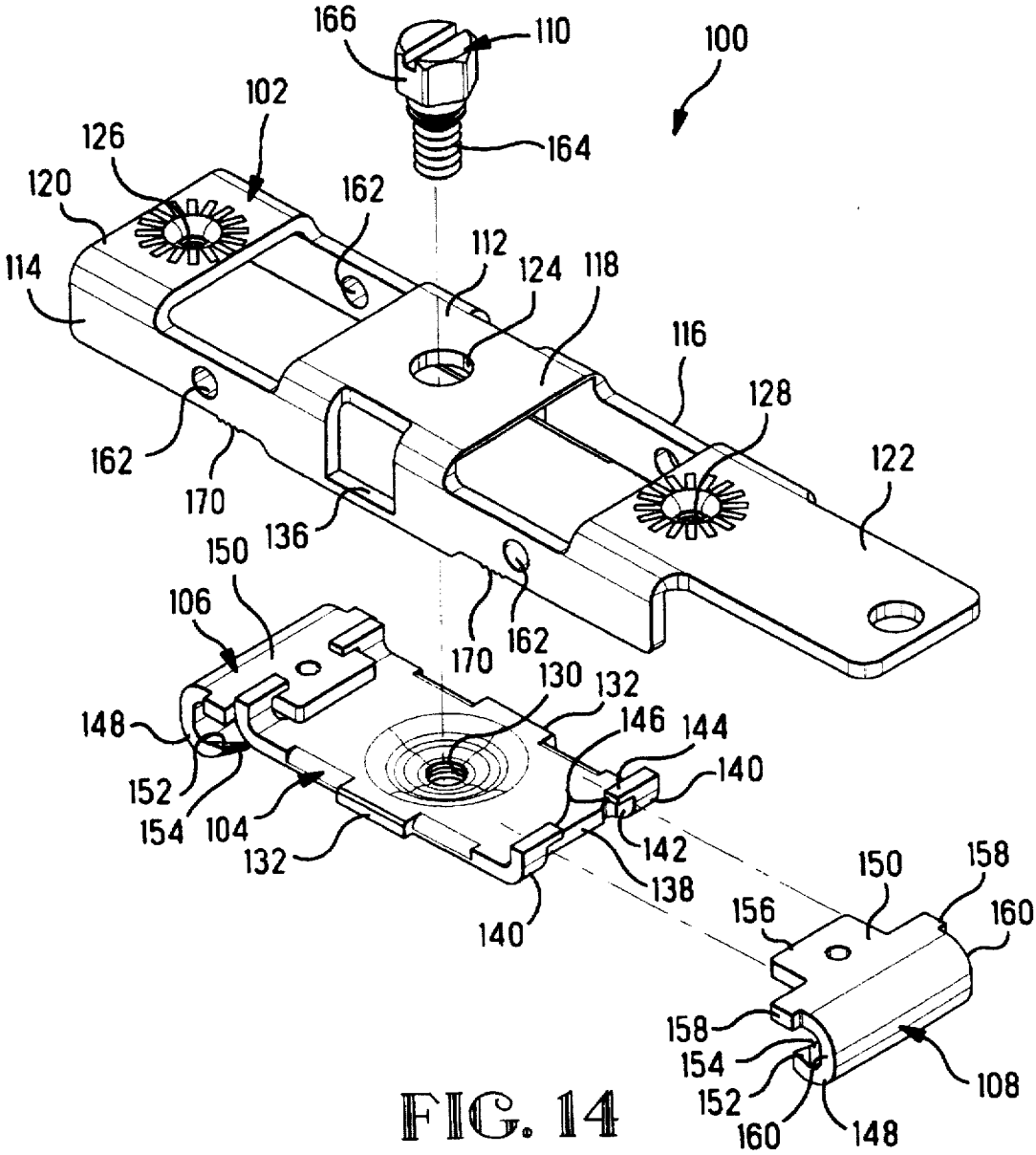
FIG. 14 is an exploded isometric view of the components of the connector of FIG. 13.

As seen in FIG. 13, large head 166 of actuator 110 projects upwardly of central top wall portion 118 of body 102, after the threaded shank has been inserted through body 102; the actuator is secured to body 102 such as by use of an E-ring 168 beneath central top wall portion 118 seated within an annular groove of actuator 110. Threaded shank 164 is threaded into threaded actuator-receiving hole 130 of carrier 104 (FIGS. 14 to 16), and tabs 132 of carrier 104 are seated loosely within windows 136 of side walls 114,116 of carrier 102. Clamps 106,108 are affixed to the connector with tongues 156 extending toward each other through respective slots 142 between pairs of flanges 140 of carrier 104, and flanges 158 are inserted into openings 162 in side walls 114,116 of body 102.

Figure 15:
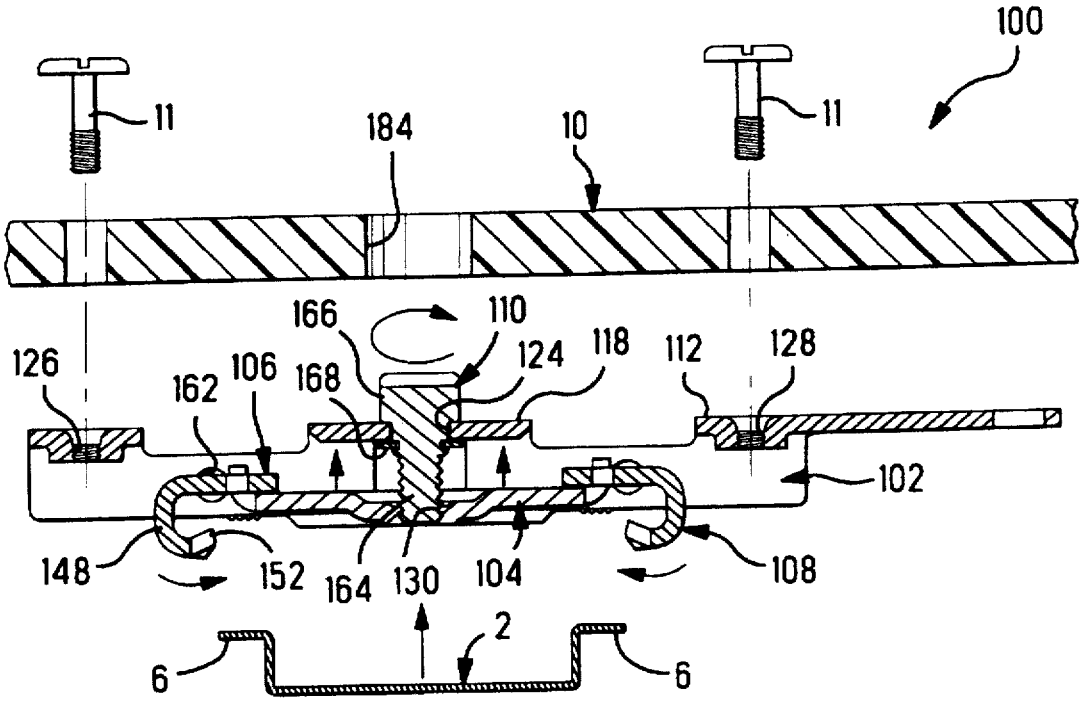
FIG. 15 is a longitudinal section view of the connector of FIGS. 13 and 14 poised above the DIN rail and being assembled beneath a substrate.
Figure 16:
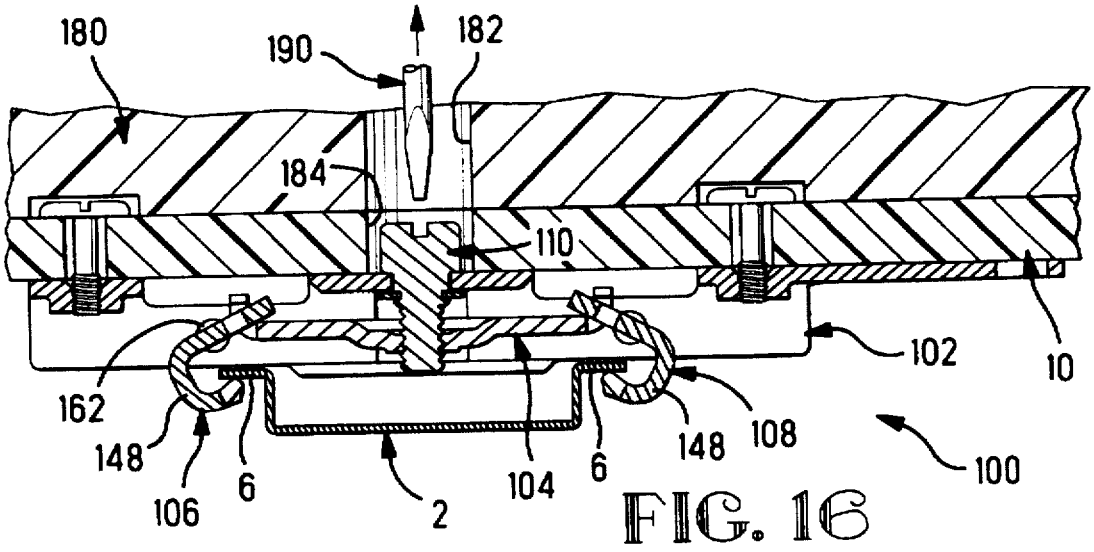
FIG. 16 is a longitudinal section view of the connector of FIGS. 13 to 15 after assembly to the substrate and mounted to the DIN rail.

Referring now to FIGS. 15 and 16, with carrier 104 in its lowermost position, clamps 106,108 are generally oriented parallel to carrier 104 so that hooks 148 are at their farthest apart position. As actuator 110 is rotated in a first direction, carrier 104 is raised with respect to body 102, tabs 132 rise within windows 136 constraining carrier to be centered with respect to body 102; tongues 156 of clamps 106,108 are moved upwardly by carrier 104 and the clamps are pivoted about flanges 158 that remain within holes 162; hooks 148 are rotated inwardly toward each other with teeth 152 moving upwardly.

Connector 100 is clamped to DIN rail 2 by being lowered thereonto when hooks 148 of clamps 106,108 are in their farthest apart position to be moved past rail flanges 6. Upon actuation of actuator 110, clamps 106,108 are pivoted so that the hooks thereof are rotated inwardly beneath rail flanges 6 and upwardly until teeth 152 bite into the bottom surfaces of the rail flanges to establish a firm mechanical clamping thereto urging the rail flanges against the bottom edges of side walls 114, 116 of body 102 which preferably have serrations 170 therealong, all thereby establishing an assured electrical grounding connection therewith by penetrating any surface oxide layers on the DIN rail flanges 6.

A substantial advantage of the connectors 1,100 of the present invention is that the connectors are adapted to be mounted beneath a circuit board 10 such as by screws 11 that mechanically affix the connectors to the circuit board and also establish an assured electrical connection between ground circuits of the circuit board and the connectors by reason of threaded holes 12,126,128 (FIGS. 2, 3, 13 and 15). The connectors are mounted in a stable orientation against the bottom surface of the circuit boards by reason of the planar top surfaces 8,112 (see FIGS. 5 and 13) abutting the bottom surface at a plurality of locations spaced apart in several directions across the surface.

Such an arrangement permits the circuit boards to be themselves affixed along bases of large modules (such as module 180 of FIG. 16), where the entire assembly 180,10,100) is manipulated as a unit to be easily secured onto a DIN rail 2, such as by use of a tool such as screwdriver 190 or a hex socket wrench utilized to rotate actuator 110 with its work end inserted through an aperture 182 through module 180 and into a hole 184 of the circuit board containing large head 166 of actuator 110. It can be seen the entire assembly is easily removable from the DIN rail by rotation of actuator 110 in the reverse direction, such as counterclockwise. Further, affixing of the entire assembly to a DIN rail can easily be accomplished when the assembly is being positioned between adjacent ones of such modules already in position, where mounting to the DIN rail cannot be visually observed, where access to the DIN rail is inhibited, and even where only strict orthogonal movement of the assembly is possible toward and away from the DIN rail.

Another advantage of the present invention is that the clamping arrangement contains clamps that are rigid and that are not resilient nor deflectable when subjected to stress, thereby assuring not only continued grounding connection to the DIN rail to counteract any vibration effects, but also to remain assuredly mounted onto the DIN rail resisting inadvertent disengagement but permitting and facilitating desired removal therefrom. Substantial clamping forces are obtainable with the present connector, to the extent of passing a physical shock test in accordance with IEC Specification 68-2-27 wherein shocks were sustained having an acceleration amplitude of 15 gravity units (15 g's), with the connector having been applied to a DIN rail at a torque of about thirty inch pounds.

Even with rigid, nondeflectable clamps, both embodiments of the present invention provide for adjustment of the spacing between the hooks of the clamps to compensate for variations in distance between edges of the rail flanges, and they also compensate for variations in thickness of the rail flanges, within ranges typical of manufacturing tolerances for the DIN rail.

What is claimed is:

1. An electrical connector for being mounted and electrically connected to a DIN rail, the DIN rail being of the type comprising an elongate channel having opposed coplanar flanges along sides thereof, comprising:

a body and an actuator, and including first and second hooks opposed and facing each other spaced apart to receive said DIN rail flanges therebetween, said first and second hooks being defined on respective discrete clamp members, both said clamp members being movable by said actuator upon actuation and deactuation thereof to move said first and second hooks relatively together and apart for rail mounting and removal respectively.

2. The connector as set forth in claim 1 wherein said actuator is a rotatable screw positioned centrally with respect to said hooks, and a tool-engageable head thereof is exposed along a top surface of said body.

3. The connector as set forth in claim 1 said body defines a planar top surface adapted on being mounted thereagainst to abut a bottom surface of a substrate at a plurality of locations spaced apart in several directions.

4. The connector as set forth in claim 1 wherein each said clamp member is rigid and nondeflectable.

5. The connector as set forth in claim 1 wherein said hooks each include at least one tooth abuttable with said rail flanges to establish assured electrical connection therewith.

6. The connector as set forth in claim 1 wherein rail-engaging edges of said body include serrations.

7. The connector as set forth in claim 1 wherein said connector further includes a carrier movable with respect to said body upon actuation to move each said at least one clamp member.

8. The connector as set forth in claim 7 wherein said carrier is movably affixed to said body in a manner permitting vertical movement with respect thereto upon actuation.

9. The connector as set forth in claim 8 wherein said carrier includes opposed tabs along side edges thereof disposed within windows through side walls of said body, permitting guided vertical movement of said carrier with respect to said body upon actuation while said side walls prevent relative rotational movement.

10. The connector as set forth in claim 7 wherein each said at least one clamp member includes a carrier-engageable portion lifted by said carrier upon actuation.

11. The connector as set forth in claim 10 wherein each said at least one clamp member include a pair of flanges trapped in openings through side walls of said body and movable within said openings upon actuation.

12. The connector as set forth in claim 11 wherein said side wall openings are circular and said movement of said pair of flanges is circular for pivoting of each said at least one clamp member upon actuation.

13. The connector as set forth in claim 11 wherein each said at least one clamp member includes a tongue disposed through and movably trapped within a slot between vertically directed end flanges of said carrier permitting a limited range of angular positions of said tongue with respect to said carrier allowing pivoting of said clamp member.

14. The connector as set forth in claim 11 wherein said side wall openings are camming slots angled upwardly and inwardly and said movement of said clamp member flanges therealong is upwardly and inwardly upon actuation for translation of said at least one clamp member and said hook thereof upwardly and inwardly to clamp onto a said rail flange.

15. An electrical connector for being mounted and electrically connected to a DIN rail, the DIN rail being of the type comprising an elongate channel having opposed coplanar flanges along sides thereof, and the connector being conductive and having a body and a pair of hooks movable relatively together upon actuation of an actuator to clamp onto the rail flanges, characterized in that:

said hooks are defined on respective clamp members that are movable together by said actuator into clamping engagement with said rail flanges.

16. The connector as set forth in claim 15, further characterized in that said connector includes a carrier movable with respect to said body upon actuation to move each said at least one clamp member.

17. The connector as set forth in claim 16, further characterized in that said side wall openings are camming slots angled upwardly and inwardly and said movement of said clamp member flanges therealong is upwardly and inwardly upon actuation for translation of said at least one clamp member and said hook thereof upwardly and inwardly to clamp onto a said rail flange.

18. The connector as set forth in claim 16, further characterized in that said carrier is movably affixed to said body in a manner permitting vertical movement with respect thereto upon actuation.

19. The connector as set forth in claim 18, further characterized in that said carrier includes opposed tabs along side edges thereof disposed within windows through side walls of said body, permitting guided vertical movement of said carrier with respect to said body upon actuation while said side walls prevent relative rotational movement.

20. The connector as set forth in claim 16, further characterized in that each said at least one clamp member includes a carrier-engageable portion lifted by said carrier upon actuation.

21. The connector as set forth in claim 16, further characterized in that each said at least one clamp member include a pair of flanges trapped in openings through side walls of said body and movable within said openings upon actuation.

22. The connector as set forth in claim 21, further characterized in that said side wall openings are circular and said movement of said pair of flanges is circular for pivoting of each said at least one clamp member upon actuation.

23. The connector as set forth in claim 21, further characterized in that each said at least one clamp member includes a tongue disposed through and movably trapped within a slot between vertically directed end flanges of said carrier permitting a limited range of angular positions of said tongue with respect to said carrier allowing pivoting of said clamp member.

* * * * *